United States Patent [19]

Kobayashi et al.

[11] Patent Number: 4,548,333

[45] Date of Patent: Oct. 22, 1985

[54] CONTAINER WITH EASY OPEN TYPE CLOSURE

[75] Inventors: Koji Kobayashi, Saitama; Keisuke Shimizu, Tokyo, both of Japan

[73] Assignees: Hokkai Can Co., Ltd., Tokyo; Snow Brand Milk Products Co., Ltd., Hokkaido, both of Japan

[21] Appl. No.: 676,871

[22] Filed: Nov. 30, 1984

[30] Foreign Application Priority Data

Dec. 2, 1983 [JP] Japan ..... 58-187095[U]

[51] Int. Cl.[4] ..... B65D 41/32

[52] U.S. Cl. ..... 220/276; 220/258; 220/270

[58] Field of Search ..... 220/257, 258, 270, 276

[56] References Cited

U.S. PATENT DOCUMENTS 4,212,409 7/1980 Jeppson ..... 220/276

4,434,908 3/1984 French ..... 220/276

*Primary Examiner*—George T. Hall

*Attorney, Agent, or Firm*—Birch, Stewart, Kolasch & Birch

[57] ABSTRACT

An easy open type closure for a container including a closure member made of at least a metallic foil sheet for being affixed together with a ring-shaped member to an edge of an opening of a container barrel body. A pull-opening member having a pulling tab connected to an initial end portion thereof and being connected to an upper surface of the closure member more firmly than a tearing strength of the closure member. The pulling tab is constructed thinner in thickness relative to the pull-opening member at least at a small thickness portion neighboring adjacent to an initial end of an interconnection portion between the pull-opening member and the closure member.

13 Claims, 9 Drawing Figures

CONTAINER WITH EASY OPEN TYPE CLOSURE

BACKGROUND OF THE INVENTION

1. Field of the Invention

The present invention relates to an easy open type container wherein an opening is tightly covered with a closure member made of at least a metallic foil. More particularly, to a container with an easy open type closure in which a pull-opening member is provided at its initial end portion with a pulling tab connected more firmly to the closure member than the tearing strength of the closure member, so that the closure member can be torn open by way of the pull-opening member by pulling the pulling tab upwards in relation to the closure member.

2. Description of Background Art

As for a container of this kind, there has been hitherto proposed by the inventors of the present invention a closure as shown in FIGS. 8 and 9 and disclosed, for instance, in Japanese Unexamined Utility Model Registration Application Publication Sho 57 (1982) - 177932. A closure member a shown in FIGS. 8 and 9 is made of a lamination comprising a metallic foil such as an aluminium foil or the like and a thermoplastic synthetic resin layer. The closure member a is applied to cover an opening of a container barrel body c and is fixed, by curling fastening or fusion adhesion, to an edge of the opening of the container barrel body c through a ring-shaped member b which is made of metal or synthetic resin. A pull-opening member f comprising a circular strip member made of thermoplastic synthetic resin or the like and having at its initial end portion a pulling tab e is applied and fixed to an area of an upper surface of the closure member a that is inside an inner edge d of the ring-shaped member b by fusion adhesion or through an adhesive agent more firmly than a tearing strength of the closure member a.

In order to tear the closure member a open, the pulling tab e is held between one's fingers and pulled upwards in relation to the closure member a, an initial tearing opening of the closure member a is made by the initial end g of the interconnection portion j. If the pulling tab e is further pulled upwards together with the pull-opening member f, the tearing of the closure member a is torn open along the inner edge d of the ring-shaped member b. In this manner, the lifting force of the pulling tab e acts to deform a flat condition of the closure member to result in generation of a resistance force, because the pull-opening member f is fixed so firmly as mentioned above to the closure member a.

If the pull-opening member f has such a high rigidity that transmits a force to the whole length of the pull-opening member f even in the case of a partial slight deformation thereof, the foregoing resistance force turns into a resistance force generated over the whole length of the pull-opening member f. Thus, the foregoing initial tearing opening cannot be made by a small pulling force. This results in an inconvenience in that it is difficult to easily tear open the closure member by children.

On the other hand, if the initial end g of the interconnetion portion j is not firmly fixed to the closure member a, an inconvenience occurs in that the pull-opening member f is peeled off from the closure member a. If the pull-opening member f and the pulling tab e connected to the initial end thereof are substantially equal one to another in thickness, a comparatively large pulling force is required for largely lifting the pulling tab e upwards at and about the initial end g of the interconnection portion j between the pull-opening member f and the closure member a, so that the foregoing inconveniences are increased. If the lifting of the pulling tab e is continued after the foregoing initial tearing opening is made, the closure member a undergoes a tearing advancing along a guide edge h provided on the pull-opening member f to reach the inner edge d of the ring-shaped member b and a tearing starting with a point X and advancing along an inside edge i of the pull-opening member f. If the lifting of the pulling tab e is further continued, the tearing which has reached the edge d is advanced along the inner edge d, while the tearing advancing along the inside edge i is advanced until it goes nearly half round, but the advancing of the tearing is stopped when the center region of the closure member a is loosened. Accordingly, the subsequent tearing stress is concentrated only on the portion extending along the inner edge d, and as a result only the tearing along the inner edge d is continued to the last, so that a complete circular opening of the container can be obtained.

However, when the pulling tab connected to the initial end of the pull-opening member f is not properly positioned in its pulling direction, it often happens that accurate tearing along the inside edge i cannot be made and the tearing advance is stopped before it proceeds halfway around. Consequently, sufficient looseness of the closure member a cannot be obtained, and accordingly the tearing stress does not concentrate only on the opening edge d. As a result, tearing occurs at an intermediate area between the inner edge d and the pull-opening member f, and there remains a piece of the closure member a which is unremoved in a position along the inner edge f so that tearing is advanced about 180 turning degrees from the initial tearing opening as shown by imaginary lines in FIG. 8.

SUMMARY AND OBJECTS OF THE INVENTION

An object of the present invention is to provide a container with an easy open type closure, wherein the foregoing inconveniences can be removed and the closure member made of a metallic foil can be torn open, easily and accurately by way of the pull-opening member.

Another object of the present invention is to provide a container of the above type, wherein especially the initial tearing opening of the closure member by the pull-opening member can be carried out easily and reliably.

A further object of the present invention is to provide a container of the above type, wherein the initial tearing opening of the closure member can be carried out easily and reliably by improving the shape of the pull-opening member.

Another object of the present invention is to provide a container of the above type, wherein in succession to the initial tearing opening along the inner edge of the ring-shaped member fixed to the edge of the container barrel body together with the closure member, the closure member can be torn open to obtain a complete circular opening without leaving any piece thereof on the inner edge of the ring-shaped member.

For achieving the foregoing objects, the present invention is directed to a container of the type wherein a closure member made of a metallic foil is fixed, together with a ring-shaped member, to an edge of an opening of a container barrel body. A pull-opening member having a pulling tab connected to an initial end portion thereof is fixed to an upper surface of the closure member more firmly than a tearing strength of the closure member. The pulling tab is made thinner in thickness than the pull-opening member at least in a portion neighboring adjacent to an initial end of an interconnection portion between the pull-opening member and the closure member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
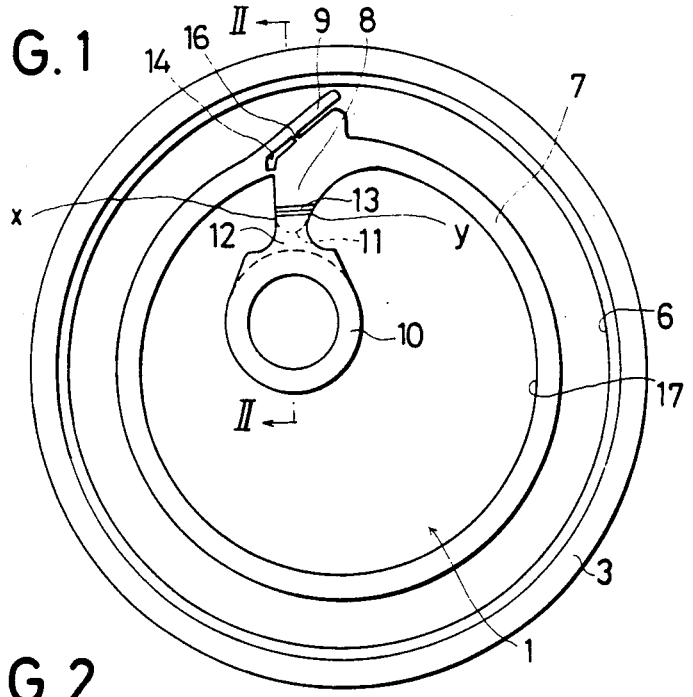
FIG. 1 is a top plan view of one embodying example of the present invention.
Figure 2:
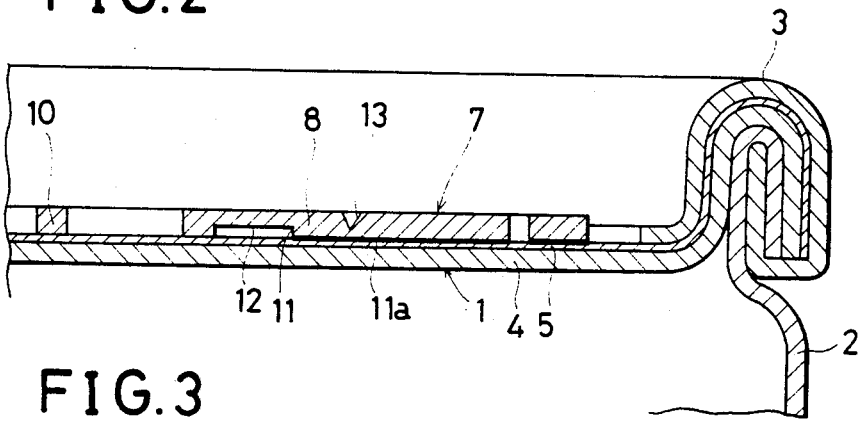
FIG. 2 is a sectional view taken along the line II—II in FIG. 1.

Referring to FIGS. 1-5 showing one embodying example of the present invention, a closure member 1 is fixed to an edge of an opening of a container barrel body 2 together with a ring-shaped member 3. The closure member 1 is made of a lamination of aluminium foil 4 and a thermoplastic synthetic resin layer 5 affixed to an upper surface of the foil for covering an opening. The ring-shaped member 3 is similar in shape to a flange portion of a usual can cover made of metal such as tin steel, a tin free steel or thermoplastic synthetic resin and is fixed through fusion adhesion of the foregoing resin layer 5 thereof to a rear surface of the member 3. The closure member 1 is fixed to an edge of the container barrel body 2 through the ring-shaped member 3 by tightly gripping them together. The closure member 1 may be made of a single layer of aluminum foil or plural layers thereof. The fixing between the closure member 1 and the can barrel body 2 may be carried out by such a procedure wherein the closure member 1 is directly fixed to the edge of the opening of the can barrel body 2 for covering the opening thereof and thereafter the ring-shaped member 3 is put on the closure member 1 and is fastened thereto.

A pull-opening member 7 is provided in the form of a circular strip made of the same material as the foregoing synthetic resin layer 5 and includes an initial end portion 8 and a final end portion 9. The initial end portion 8 and the final end portion 9 are separably interconnected by a breakable connecting bridge 16, and the pull-opening member has a ring-shaped pulling tab 10 connected to the initial end portion 8 thereof. The pull-opening member 7 is so positioned on an upper surface of the closure member 1 so as to leave a desired distance from an inner edge 6 of the ring-shaped member 3 and is connected thereto more firmly than the tearing strength of the closure member 1. Thus, there is formed an interconnection portion 11*a* between the pull-opening member 7 and the closure member 1 and an initial end 11 of the interconnection portion is located at a position shown by broken lines in FIG. 1.

The pulling tab 10 is sufficient if it is positioned so as to be spaced from an upper surface of the closure member 1 or if it is adhered thereto so lightly as to be easily peelable therefrom. The material of the pull-opening member 7 is not limited to the same as the foregoing synthetic resin layer 5. Any desired type of material may be used as long as it is constructed to have a tearing strength greater than the tearing strength of the closure member 1. The means for connecting the closure member 1 is not limited to fusion adhesion. Any adhesive agent which has a bonding strength which is stronger than the tear strength of the closure member 1 may be used.

Figure 3:
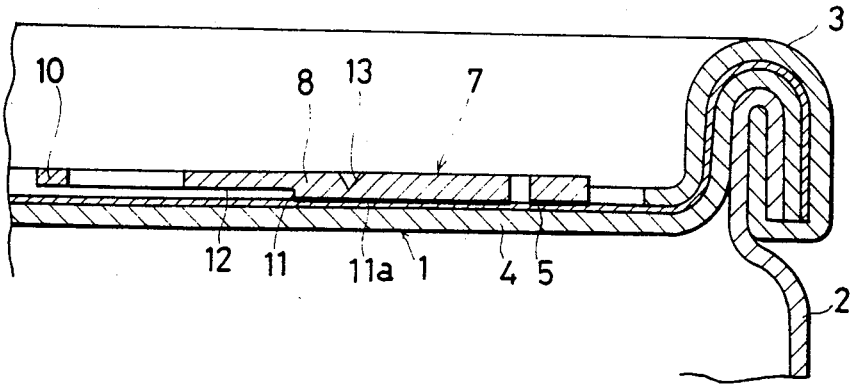
FIG. 3 is a sectional view similar to FIG. 2 for showing a partly modified embodiment of the example of the present invention.

A thin part 12 of the pulling tab 10 is formed on a side of the pulling tab 10 that neighbors on the initial end 11*a* of the interconnection portion 11 between the pull-opening member 7 and the closure member 1. The thin part 12 is connected to the initial end of the pull-opening member 7 and is thinner than the pull-opening member 7 so as to leave a space between the lower surface of the thin part 12 and the surface of the closure member 1. This construction is advantageous in that the pulling tab 10 can be easily bent due to its thin part 12 when the pulling tab 10 is pulled upwards in the direction away from the closure member 1. The thin part 12 in FIG. 2 may be modified as shown in FIG. 3. Namely, the upper surface of the pulling tab 10 may be juxtaposed on the same level as the upper surface of the pull-opening member 7. The whole area of the pulling tab may be constructed thinner so that a space is provided between the whole area of the pulling tab 10 and the closure member 1.

A weakened part 13 is provided in the pull-opening member 7 which is decreased in rigidity by making a recess therein. The weakened part 13 is positioned on the upper surface of the initial end portion 8 of the pull-opening member 7 which corresponds to a position more or less advanced from the initial end 11 of the interconnection portion 11*a* between the pull-opening member 7 and the closure member 1. The recess may be constructed, for example, by providing a notch of about 0.5 mm in depth in a case where the thickness of the pull-opening member 7 is about 1 mm, so that there is provided in the member 7 the weakened part 13 which is smaller in rigidity than the remaining portion of the pull-opening member 7 itself. Accordingly, a region of the interconnection portion between the pull-opening member 7 and the closure member 1 that extends between the weakened part 13 and the initial end 11 of the interconnection portion 11*a* serves as an initial stage tearing opening region to be created when the closure member 1 is torn open by way of the pull-opening member 7 by lifting the pulling tab 10.

A guide edge 14 is provided and directed towards the inner edge 6 of the ring-shaped member 3 and is formed on the initial end portion 8 which is in opposite to the final end portion 9 of the pull-opening member 7. The guide edge 14 functions in such a manner that, when the closure member 1 is being torn open by way of the pull-opening member 7 by lifting the pulling tab 10, the guide edge 14 provides a tearing of the closure member 1 which occurs along the initial end portion 8 of the pull-opening member 7 and is guided to advance towards the edge 6.

Figure 4:
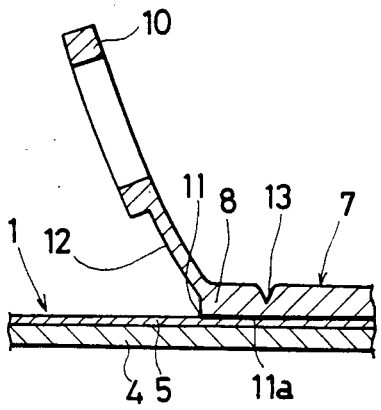
FIGS. 4 and 5 are sectional views for showing an opening procedure thereof.
Figure 5:
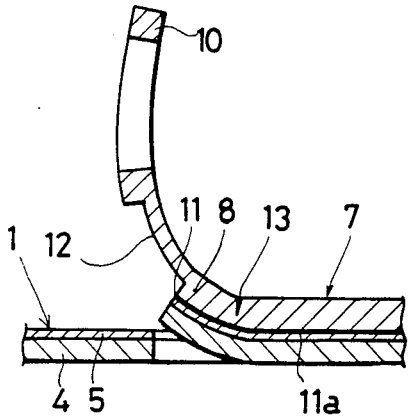

An opening operation of the container set forth in the foregoing example will be explained hereinafter. First of all, the pulling tab 10 is held by an individual's fingers and is pulled upwards as shown in FIG. 4, the pulling tab 10 is bent at the thin part 12 to be raised easily to an upright posture. On this occasion, the upward pulling force of the pulling tab 10 provides a large shearing force applied nearly perpendicularly to the horizontal closure member 1 as shown in FIG. 4. If the pulling tab 10 is further pulled upwards as shown in FIG. 5, the initial end 11 of the interconnection portion 11*a* of the pull-opening member 7 is lifted, by a lever action having its fulcrum at the weakened part 13 to result in a cutting of the closure member 1 at the point corresponding to the initial end 11. Thus, the initial beginning of the tearing opening operation of the closure member 1 can be easily achieved.

In the course of lifting the pulling tab 10, there is generated a lifting force at a portion of the closure member 1 that corresponds to the initial end 11 of the interconnection portion 11*a*. In addition, a shearing force is created between the foregoing lifting force and a resisting force for keeping the closure member 1 in its horizontal condition. Owing to the fact that the pull-opening member 7 is provided with the weakened part 13, the pull-opening member 7 is decreased in its rigidity at the weakened part 13 and the lifting force does not transmit to the whole of the pull-opening member 7. Therefore, the lifting force can be concentrated to be bent to the initial end of the pull-opening member 7 about the weakened part 13 to give to that end a large shearing force. Thereby, an initial stage of the tearing opening operation can be easily carried out.

In the foregoing example, for decreasing the necessary shearing force, the initial end 11 of the interconnection portion 11*a* is formed in a semicircle to narrow the width of the end of the pull-opening member.

Next, the subsequent tearing process after the initial stage tearing opening is made will be explained hereinafter. If, after the initial stage tearing opening is completed as mentioned above, the pulling tab 10 is further pulled upwards and the closure member 1 is torn starting with a point X and advancing along the guide edge 14 to reach the inner edge 6 of the ring-shaped member 3. The tearing starts with a point Y and advances along an inside edge 17 of the pull-opening member 7. Thereafter, the outside tearing is advanced along the inner edge 6, and at the same time the inside tearing along the inside edge 17 is advanced but is stopped when it reaches nearly a middle portion of the inside edge 17 of the circle pull-opening member 7. The reason for discontinuation of the inside tearing is that there is generated a looseness of the closure member 1 at the center region thereof with the progress of the two inside and outside tearing sections extending therealong. Thereby, the concentration of the tearing stress on a portion extending along the inside edge 17 is dissipated. Accordingly, the tearing stress is concentrated only on a portion extending along the inner edge 6 of the ring-shaped member 3. Thus, only the outside tearing is continued to the end to obtain a complete circular opening.

Figure 6:
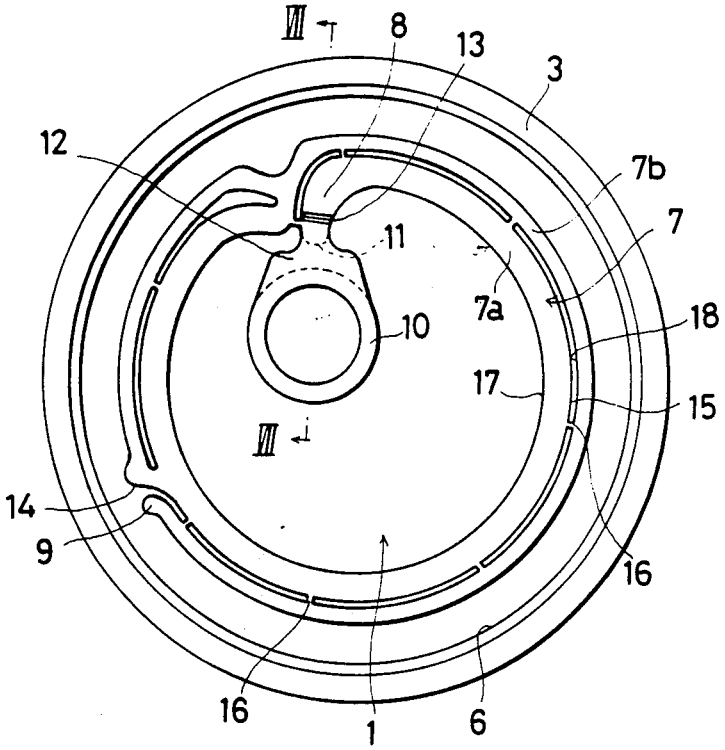
FIG. 6 is a top plan view of another embodying example of the present invention.
Figure 7:
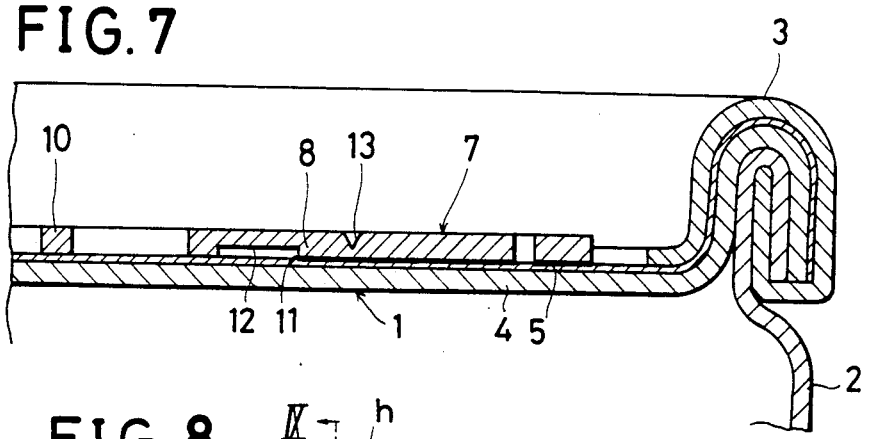
FIG. 7 is a sectional view taken along the line VII—VII in FIG. 6.
Figure 8:
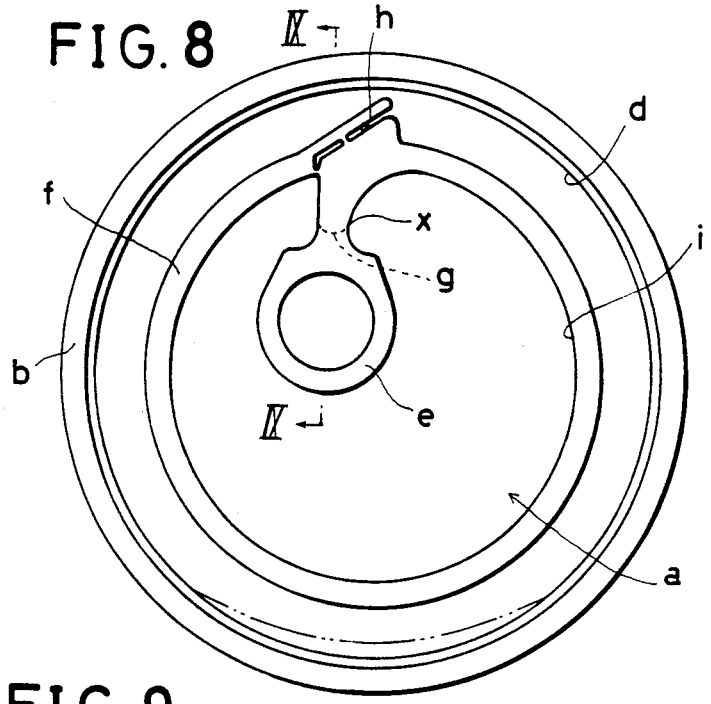
FIG. 8 is a top plan view of a conventional example.
Figure 9:
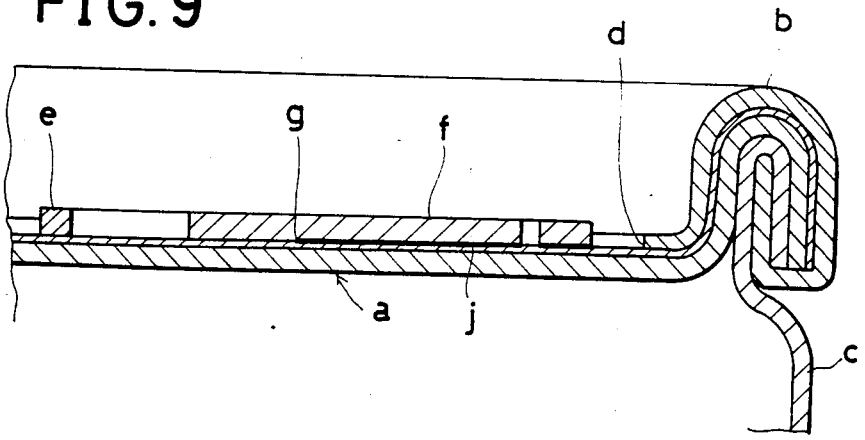
FIG. 9 is a sectional view taken along the line IX—IX in FIG. 8.

FIGS. 6 and 7 show another embodying example of the present invention. This embodying example is substantially similar to the foregoing example, except for the shape of the pull-opening member 7. In the foregoing example in which the pull-opening member 7 is a single circular one, in the course of tearing the closure member 1 along the inner edge 6 of the ring-shaped member 3 by way of the pull-opening member 7, if the pulling direction of the pull-opening member 7 is not proper, it often happens that the closure member 1 is not torn completely along the inner edge 6 and there is left a piece of the closure member 1 remaining unremoved as shown by the imaginary line in FIG. 8.

For preventing the generation of a remainder piece of the closure member in the opening of the container, the embodiment illustrated in FIGS. 6 and 7 provides an improved shape of the pull-opening member 7. Namely, the pull-opening member 7 is constructed of the same material as in the foregoing example in FIGS. 1–3, but is formed into a swirl-shaped strip so that, in continuation with an inner circular strip portion 7*a* circling around and having the initial end portion 8 to which the pulling tab 10 is connected, an extended outer circular strip portion 7*b* circles about $\frac{3}{4}$ of the way around the circle and includes the final end portion 9 which is provided around the inner circular strip portion 7*a*.

The two strip portions 7*a*, 7*b* are disposed to leave a slight space therebetween, and are interconnected at several places by the several breakable connecting bridges 16. The outside edge 15 of the circular strip portion 7*a* is provided at its position corresponding to about $\frac{3}{4}$ of the way around the circular strip portion 7*a* with the guide edge 14 which faces the final end portion 9 of the strip portion 7*b* and is directed towards the edge 6 of the ring-shaped member 3.

Next, a manner of opening of the container in the second embodiment of the present invention will be explained as follows. This example is not different from the foregoing example in that by pulling tab 10 upwards the initial tearing opening of the closure member 1 is made by way of the thin part and the weakened part 13. If, thereafter, the pulling tab 10 is further pulled upwards and thereby the pull-opening member 7 is lifted gradually from its initial end portion 8, a tearing advancing along an outside edge 15 of the portion 7*a* and the inside edge 18 of the strip portion 7*b* and a tearing advancing along the inside edge 17 of the strip portion 7*a* are achieved. If the pulling tab 10 is further pulled upwards, the tearing extending along the inside edge 17 of the strip portion 7*a* is stopped at a position where the tearing has been advanced nearly half way around, because the center region of the closure member 1 becomes liable to be loosen with an advance of the tearing thereof.

Consequently, only the tearing extending along the outside edge 15 of the strip portion 7*a* is continued, and this tearing is directed towards the edge 6 of the ring-shaped member 3 by the guide edge 14. Thereafter, owing to the fact that such an intermediate region of the closure member 1 between the strip portion *7b* and the inner edge 6 is kept in its tension condition, while the closure member portion along the inside edge 18 of the portion *7b* has been torn off, the subsequent tearing stress is concentrated only on a portion extending along the edge 6, and accordingly the closure member 1 is torn off along the inner edge 6 without fail and the whole surface of the closure member can be removed.

According to the present invention, the pulling tab connected to the initial end portion of the pull-opening member is made thinner than the pull-opening member at least at its portion which neighbors adjacent to the initial end of the interconnection portion between the closure member and the pull-opening member. Thus, when the pulling tab is pulled upwards in order to tear the closure member open, the pulling tab can be raised easily nearly to an upright position vertical to the closure member. Accordingly, a shearing force can be effectively applied to the initial end of the interconnection portion and consequently the initial tearing opening can be made easily and reliably. Additionally, the pull-opening member is provided, at its portion slightly advanced from the initial end of the interconnection portion, with the weakened part such as a V notch or the like, so that when the pulling tab is pulled upwards, a lever action having its fulcrum at the weakened part can be generated to exert on one end of an intermediate region between the initial end of the interconnection portion and the weakened part. Thereby, an effective shearing force can be generated at the initial end of the interconnection portion, and thus the initial tearing opening can be made easily and reliably.

In addition, the pull-opening member is formed into a circular strip that includes a final end portion and an initial end portion, and the initial end portion is provided with the guide edge facing the final end portion and is directed towards the edge of the ring-shaped member on the outer circumferential region of the closure member, so that the closure member can be torn open along the edge by way of the pull-opening member. Additionally, the pull-opening member is formed into a vortex strip of inner and outer doubled strip portions. The inside end portion thereof is provided with the pulling tab, and the intermediate portion of the inside strip portion which is opposite to the final end portion of the vortex strip is formed with the guide edge directed towards the inner edge of the ring-shaped member. In this manner, the closure member can be torn open by way of pulling the pull-opening member reliably along the inner edge, without any remaining part of the closure member left along the inner edge, so that a complete circular opening can be carried out.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An easy open type closure for a container comprising:

a closure member made of at least a metallic foil sheet for being affixed together with a ring-shaped member to an edge of an opening of a container barrel body; and a pull-opening member having a pulling tab connected to an initial end portion thereof and being connected to an upper surface of the closure member more firmly than a tearing strength of the closure member;

said pulling tab is constructed thinner in thickness relative to the pull-opening member at least at a small thickness portion neighboring adjacent to an initial end of an interconnection portion between the pull-opening member and the closure member.

2. A container according to claim 1, wherein the closure member is affixed to a rear surface of the ring-shaped member in order to close an opening of the ring-shaped member, and is fixed through the ring-shaped member to the edge of the opening of the container barrel body.

3. A container according to claim 1, wherein the pulling tab is partially constructed thinner relative to the pull-opening member.

4. A container according to claim 1, wherein the pulling tab is wholly constructed thinner relative to the pull-opening member.

5. A container according to claim 1, wherein the pulling tab is constructed thinner so as to be spaced from an upper surface of the closure member.

6. A container according to claim 1, wherein a weakened part is constructed in the pull-opening member at such a position that is advanced, in tearing, from the initial end of the interconnection portion.

7. A container according to claim 6, wherein the weakened part thereof is a notched part made in an upper surface of the pull-opening member.

8. A container according to claim 1, wherein the pull-opening member is in the form of a circular strip including an initial portion connected to the pulling tab and a final end portion.

9. A container according to claim 8, wherein the initial end portion of the pull-opening member is provided, at its position facing the final end portion thereof, with a guide edge directed towards an inner edge of the ring-shaped member.

10. A container according to claim 1, wherein the pull-opening member is in the form of an inner and outer doubled swirl shaped strip including an end portion of an inside strip portion being the initial end portion having the pulling tab connected to the end thereof.

11. A container according to claim 10, wherein the swirl shaped pull-opening member is provided, at its middle position facing the final end portion thereof, with a guide edge directing towards the inner edge of the ring-shaped member.

12. An easy open type closure for a container comprising:

a substantially flat closure member constructed of at least a metallic foil sheet and including an upper surface and a lower surface, said lower surface being adapted to be affixed to an opening in a container barrel and secured thereto with a ring-shaped member;

a pull-opening member being substantially flat and secured along a predetermined path to said upper surface of said closure member more firmly than a tearing strength of the closure member; and a pulling tab affixed to said pull-opening member, said pulling tab being constructed of a thinner thickness relative to the thickness of said pull-opening member at least at the portion neighboring adjacent to an initial end of an interconnection portion between the pulling opening member and the closure member;

wherein said pulling tab may be manually displaced relative to said closure member to provide a large shearing force substantially perpendicularly to said closure member to initially puncture said closure member.

13. An easy open type closure according to claim 12, wherein said pull-opening member is substantially circular in shape and is secured to said closure member along a substantially circular path to form a substantially circular opening when removed.

* * * * *